US011219811B2

(12) United States Patent
Dugan

(10) Patent No.: US 11,219,811 B2
(45) **Date of Patent: *Jan. 11, 2022**

(54) SYSTEMS AND METHODS FOR MEASURING AND/OR ANALYZING SWING INFORMATION

(71) Applicant: Dugan Patents, LLC, Sleepy Hollow, NY (US)

(72) Inventor: Brian M. Dugan, Sleepy Hollow, NY (US)

(73) Assignee: Dugan Patents, LLC, Sleepy Hollow, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/029,033

(22) Filed: Sep. 22, 2020

(65) Prior Publication Data

US 2021/0001199 A1 Jan. 7, 2021

Related U.S. Application Data

(63) Continuation of application No. 16/243,046, filed on Jan. 8, 2019, now Pat. No. 10,835,800, which is a (Continued)

(51) Int. Cl.
*A63B 69/36* (2006.01)
*A63B 69/38* (2006.01)
(Continued)

(52) U.S. Cl.
CPC ..... *A63B 69/3614* (2013.01); *A63B 24/0003* (2013.01); *A63B 69/36* (2013.01);
(Continued)

(58) Field of Classification Search
CPC ..... A63B 69/3614; A63B 24/0003; A63B 69/3632; A63B 69/3623; A63B 69/36;
(Continued)

(56) References Cited

U.S. PATENT DOCUMENTS 3,717,857 A 2/1973 Evans
3,788,647 A 1/1974 Evans
(Continued)

OTHER PUBLICATIONS

U.S. Appl. No. 17/022,069, filed Sep. 1, 2020, Dugan.
(Continued)

*Primary Examiner* — Nini F Legesse
(74) *Attorney, Agent, or Firm* — Dugan & Dugan, PC

(57) ABSTRACT

In a first aspect, a system for monitoring a swing is provided that includes (1) a swing measurement device adapted to couple to a swinging object and to output a signal indicative of a characteristic of the swinging object; (2) a wireless transmitter coupled to the swing measurement device and adapted to wirelessly transmit the signal output by the swing measurement device; and (3) a wireless device adapted to receive the wirelessly transmitted signal and to provide information regarding the swinging object based on the received signal. The wireless device is a cellular telephone or personal digital assistant (PDA). Numerous other aspects are provided.

20 Claims, 4 Drawing Sheets

Related U.S. Application Data continuation of application No. 15/666,549, filed on Aug. 1, 2017, now Pat. No. 10,201,739, which is a continuation of application No. 14/337,206, filed on Jul. 21, 2014, now Pat. No. 9,731,182, which is a continuation of application No. 13/708,928, filed on Dec. 8, 2012, now Pat. No. 8,808,102, which is a continuation of application No. 11/869,695, filed on Oct. 9, 2007, now Pat. No. 8,337,335.

(60) Provisional application No. 60/828,635, filed on Oct. 7, 2006.

(51) Int. Cl.
*A63B 24/00* (2006.01)
*A63B 102/32* (2015.01)
*A63B 71/06* (2006.01)

(52) U.S. Cl.
CPC ..... *A63B 69/3623* (2013.01); *A63B 69/3632* (2013.01); *A63B 69/38* (2013.01); *A63B 69/3605* (2020.08); *A63B 2071/0625* (2013.01); *A63B 2071/0627* (2013.01); *A63B 2102/32* (2015.10); *A63B 2220/40* (2013.01); *A63B 2225/20* (2013.01); *A63B 2225/50* (2013.01)

(58) Field of Classification Search
CPC ..... A63B 69/38; A63B 2225/20; A63B 2071/0625; A63B 2225/50; A63B 2071/0627; A63B 2102/32; A63B 69/3605; A63B 2220/40
USPC ..... 473/131, 219, 221, 222, 223, 226, 233, 473/234
See application file for complete search history.

(56) References Cited

U.S. PATENT DOCUMENTS

| | | | | |
|---|---|---|---|---|
| 3,815,427 | A | 6/1974 | Gladstone | |
| 4,991,850 | A | 2/1991 | Wilhlem | |
| 5,056,783 | A | 10/1991 | Matcovich et al. | |
| 5,174,577 | A | 12/1992 | Warde et al. | |
| 5,221,088 | A | 6/1993 | McTeigue et al. | |
| 5,233,544 | A | 8/1993 | Kobayashi | |
| 5,257,084 | A | 10/1993 | Marsh | |
| 5,688,183 | A | 11/1997 | Sabatino et al. | |
| 5,694,340 | A | 12/1997 | Kim | |
| 5,741,182 | A | 4/1998 | Lipps et al. | |
| 5,911,635 | A | 6/1999 | Ogden | |
| 6,045,364 | A | 4/2000 | Dugan | |
| 6,173,610 | B1 | 1/2001 | Pace | |
| 6,261,102 | B1 | 7/2001 | Dugan et al. | |
| 6,811,516 | B1 | 11/2004 | Dugan | |
| 6,819,247 | B2 | 11/2004 | Birnbach et al. | |
| 7,021,140 | B2 | 4/2006 | Perkins | |
| 7,736,242 | B2 | 6/2010 | Stites | |
| 7,922,586 | B2 | 4/2011 | Heckendorf | |
| 7,946,926 | B1 | 5/2011 | Balardeta et al. | |
| 8,337,335 | B2 * | 12/2012 | Dugan | A63B 69/3623 473/212 |
| 8,430,770 | B2 | 4/2013 | Dugan | |
| 8,808,102 | B2 * | 8/2014 | Dugan | A63B 69/3623 473/212 |
| 8,808,114 | B2 | 8/2014 | Dugan | |
| 9,566,495 | B2 * | 2/2017 | Dugan | A63B 69/3623 |
| 9,731,182 | B2 * | 8/2017 | Dugan | A63B 69/38 |
| 9,975,001 | B2 | 5/2018 | Dugan | |
| 10,201,739 | B2 | 2/2019 | Dugan | |
| 2001/0048364 | A1 | 12/2001 | Kalthoff et al. | |
| 2002/0019677 | A1 | 2/2002 | Lee | |
| 2002/0072815 | A1 | 6/2002 | McDonough | |
| 2003/0207718 | A1 | 11/2003 | Perlmutter | |
| 2005/0032525 | A1 | 2/2005 | Gasbarro | |
| 2005/0215340 | A1 | 9/2005 | Stites et al. | |
| 2005/0288119 | A1 | 12/2005 | Wang et al. | |
| 2006/0025229 | A1 | 2/2006 | Mahajan et al. | |
| 2007/0021269 | A1 | 1/2007 | Shum | |
| 2007/0111811 | A1 | 5/2007 | Grober | |
| 2007/0135225 | A1 | 6/2007 | Nieminen et al. | |
| 2009/0231960 | A1 | 9/2009 | Hutcheson | |
| 2009/0298605 | A1 | 12/2009 | Wiegers | |
| 2010/0049468 | A1 | 2/2010 | Papadourakis | |
| 2010/0130298 | A1 | 5/2010 | Dugan et al. | |
| 2010/0222152 | A1 | 9/2010 | Jaekel et al. | |
| 2011/0151986 | A1 | 6/2011 | Denton et al. | |
| 2011/0224012 | A1 | 9/2011 | Hashimoto | |
| 2012/0052972 | A1 | 3/2012 | Bentley | |
| 2012/0286114 | A1 | 11/2012 | Jertson | |
| 2012/0289354 | A1 | 11/2012 | Cottam | |
| 2013/0095940 | A1 | 4/2013 | Dugan | |
| 2013/0150121 | A1 | 6/2013 | Jeffery | |
| 2013/0165246 | A1 | 6/2013 | Jeffery | |
| 2013/0225335 | A1 | 8/2013 | Dugan | |
| 2014/0018181 | A1 | 1/2014 | Blake | |
| 2014/0335965 | A1 | 11/2014 | Dugan | |
| 2014/0335978 | A1 | 11/2014 | Dugan | |
| 2017/0106237 | A1 | 4/2017 | Dugan | |
| 2017/0348580 | A1 | 12/2017 | Dugan | |
| 2018/0243609 | A1 | 8/2018 | Dugan | |
| 2019/0143190 | A1 | 5/2019 | Dugan | |

OTHER PUBLICATIONS

Notice of Allowance of U.S. Appl. No. 08/858,824 dated Sep. 1, 1998.
Notice of Abandonment of U.S. Appl. No. 08/858,824 dated Feb. 3, 1999.
Withdrawal of Notice of Allowance of U.S. Appl. No. 08/858,824 dated May 11, 1999.
Notice of Allowance of U.S. Appl. No. 08/858,824 dated Jul. 30, 1999.
Office Action of U.S. Appl. No. 11/869,695 dated Nov. 17, 2009.
Feb. 17, 2010 Response to Office Action of U.S. Appl. No. 11/869,695 dated Nov. 17, 2009.
Final Office Action of U.S. Appl. No. 11/869,695 dated May 26, 2010.
Interview Summary of U.S. Appl. No. 11/869,695 filed Feb. 3, 2010.
Interview Summary of U.S. Appl. No. 11/869,695 filed Feb. 17, 2010.
Amendment After Final submitted with RCE of U.S. Appl. No. 11/869,695 filed Aug. 26, 2010.
Office Action of U.S. Appl. No. 11/869,695 dated Oct. 18, 2010.
Mar. 18, 2011 Response to Office Action of U.S. Appl. No. 11/869,695 dated Oct. 18, 2010.
Final Office Action of U.S. Appl. No. 11/869,695 dated Jun. 21, 2011.
Amendment Submitted with RCE of U.S. Appl. No. 11/869,695 filed Dec. 21, 2011.
Office Action of U.S. Appl. No. 11/869,695 dated Feb. 16, 2012.
Aug. 16, 2012 Response to Office Action of U.S. Appl. No. 11/869,695.
Notice of Non-Compliant Amendment of U.S. Appl. No. 11/869,695 dated Aug. 21, 2012.
Aug. 23, 2012 Response to Notice of Non-Compliant Amendment of U.S. Appl. No. 11/869,695.
Notice of Allowance of U.S. Appl. No. 11/869,695 dated Sep. 18, 2012.
Office Action of U.S. Appl. No. 12/696,040 dated Jun. 8, 2011.
Nov. 8, 2011 Response to Office Action of U.S. Appl. No. 12/696,040.
Final Office Action of U.S. Appl. No. 12/696,040 dated Jan. 18, 2012.
Examiner Interview Summary of U.S. Appl. No. 12/696,040 dated Jul. 2, 2012.

(56) References Cited

OTHER PUBLICATIONS

Amendment Submitted with RCE of U.S. Appl. No. 12/696,040 filed Jul. 18, 2012.
Notice of Allowance of U.S. Appl. No. 12/696,040 dated Jul. 27, 2012.
Interview Summary of U.S. Appl. No. 12/696,040 filed Nov. 26, 2012.
Notice of Allowance of U.S. Appl. No. 12/696,040 dated Nov. 29, 2012.
Office Action of U.S. Appl. No. 13/708,928 dated Mar. 1, 2013.
Aug. 30, 2013 Reply to Mar. 1, 2013 Office Action of U.S. Appl. No. 13/708,928.
Final Office Action of U.S. Appl. No. 13/708,928 dated Nov. 6, 2013.
Amendment Submitted with RCE of U.S. Appl. No. 13/708,928 filed Apr. 7, 2014.
Office Action of U.S. Appl. No. 13/846,908 dated Nov. 29, 2013.
Apr. 29, 2014 Reply to Office Action and Terminal Disclaimers of U.S. Appl. No. 13/846,908.
Office Action of U.S. Appl. No. 13/708,928 dated May 16, 2014.
Terminal Disclaimers of U.S. Appl. No. 13/846,908 filed Jun. 4, 2014.
Jun. 5, 2014 Reply to Office Action and Terminal Disclaimer of U.S. Appl. No. 13/708,928.
Notice of Allowance of U.S. Appl. No. 13/708,928 dated Jul. 1, 2014.
Notice of Allowance of U.S. Appl. No. 13/846,908 dated Jul. 3, 2014.
Preliminary Amendment of U.S. Appl. No. 14/338,341 filed Aug. 23, 2014.
Non-Final Office Action of U.S. Appl. No. 14/338,341 filed Jan. 20, 2016.
Non-Final Office Action of U.S. Appl. No. 14/337,206 dated Feb. 1, 2016.
Jul. 20, 2016 Reply to Jan. 20, 2016 Non-Final Office Action of U.S. Appl. No. 14/338,341.
Aug. 1, 2016 Reply to Feb. 1, 2016 Non-Final Office Action of U.S. Appl. No. 14/337,206.
Final Office Action of U.S. Appl. No. 14/337,206 dated Sep. 27, 2016.
Notice of Allowance of U.S. Appl. No. 14/338,341 dated Sep. 29, 2016.
Dec. 27, 2016 Reply to Sep. 27, 2016 Final Office Action and Terminal Disclaimers of U.S. Appl. No. 14/337,206.
Non-Final Office Action of U.S. Appl. No. 15/394,803 dated Aug. 24, 2017.
Non-Final Office Action of U.S. Appl. No. 15/666,549, dated Jan. 12, 2018.
Nov. 24, 2017 Reply and Terminal Disclaimers to Aug. 24, 2017 Non-Final Office Action of U.S. Appl. No. 15/394,803.
Notice of Allowance of U.S. Appl. No. 15/394,803 dated Jan. 19, 2018.
May 14, 2018 Reply to Jan. 12, 2018 Non-Final Office Action of U.S. Appl. No. 15/666,549.
Notice of Allowance of U.S. Appl. No. 15/666,549 dated Sep. 24, 2018.
Non-Final Office Action of U.S. Appl. No. 15/968,304 dated Jun. 19, 2019.
Non-Final Office Action of U.S. Appl. No. 16/243,046 dated Jul. 17, 2019.
Nov. 19, 2019 Reply to Jun. 12, 2019 Non-Final Office Action of U.S. Appl. No. 15/968,304.
Nov. 18, 2019 Reply to Jul. 17, 2019 Non-Final Office Action of U.S. Appl. No. 16/243,046.
Jan. 23, 2020 Notice of Allowance of U.S. Appl. No. 15/968,304.
Jan. 23, 2020 Notice of Allowance of U.S. Appl. No. 16/243,046.
Amendment submitted with RCE of U.S. Appl. No. 15/968,304 filed Apr. 23, 2020.
Amendment submitted with RCE of U.S. Appl. No. 16/243,046 filed Apr. 23, 2020.
Jun. 11, 2020 Notice of Allowance of U.S. Appl. No. 15/968,304.
Jun. 11, 2020 Notice of Allowance of U.S. Appl. No. 16/243,046.
312 Amendment of U.S. Appl. No. 15/968,304 filed Sep. 11, 2020.

* cited by examiner

SYSTEMS AND METHODS FOR MEASURING AND/OR ANALYZING SWING INFORMATION

This application is a continuation of and claims priority to U.S. patent application Ser. No. 16/243,046, filed Jan. 8, 2019, and titled "SYSTEMS AND METHODS FOR MEASURING AND/OR ANALYZING SWING INFORMATION," which is a continuation of and claims priority to U.S. patent application Ser. No. 15/666,549 filed Aug. 1, 2017, now U.S. Pat. No. 10,201,739 and titled "SYSTEMS AND METHODS FOR MEASURING AND/OR ANALYZING SWING INFORMATION", which is a continuation of and claims priority to U.S. patent application Ser. No. 14/337,206 filed Jul. 21, 2014, now U.S. Pat. No. 9,731,182 and titled "SYSTEMS AND METHODS FOR MEASURING AND/OR ANALYZING SWING INFORMATION", which is a continuation of and claims priority to U.S. patent application Ser. No. 13/708,928 filed Dec. 8, 2012, now U.S. Pat. No. 8,808,102 and titled "SYSTEMS AND METHODS FOR MEASURING AND/OR ANALYZING SWING INFORMATION", which is a continuation of and claims priority to U.S. patent application Ser. No. 11/869,695 filed Oct. 9, 2007, now U.S. Pat. No. 8,337,335 and titled "SYSTEMS AND METHODS FOR MEASURING AND/OR ANALYZING SWING INFORMATION", which claims priority from U.S. Provisional Patent Application Ser. No. 60/828,635, filed Oct. 7, 2006 and entitled "SYSTEMS AND METHODS FOR MEASURING AND/OR ANALYZING SWING INFORMATION", each of which is hereby incorporated by reference herein in its entirety.

The present application is also related to U.S. Pat. No. 6,045,364, issued Apr. 4, 2000, which is hereby incorporated by reference herein in its entirety.

FIELD OF THE INVENTION

The present invention relates to the use of wireless devices for improving a swing such as a golf swing, a tennis swing, etc., and more particularly to systems and methods for measuring and/or analyzing swing information.

BACKGROUND OF THE INVENTION

A difficult challenge in swing intensive sporting activities (e.g., golf or tennis) is to perfect a swing and repeat it consistently. The pace of a swing, also known as swing tempo, is an important factor in most swing intensive activities as proper swing tempo is indicative of proper body position and proper body motion. In golf, for example, proper golf swing tempo ensures that golf club head velocity and golf club head position are optimized during a golf swing. As such, a device which assists a golfer in consistently repeating proper swing tempo can be an invaluable teaching aid or training device.

To be effective, a swing tempo training device should provide "real-time" feedback (e.g., sufficiently instantaneous and continuous to allow modification of a swing during the swing). Real-time feedback provides real-time information which allows a person to know during a swing whether swing tempo should be increased, decreased, or maintained.

A need therefore exists for a swing tempo training device which may provide real-time feedback, preferably without disturbing others and without creating artificial vibrations during a swing.

SUMMARY OF THE INVENTION

In a first aspect of the invention, a system for monitoring a swing is provided that includes (1) a swing measurement device adapted to couple to a swinging object and to output a signal indicative of a characteristic of the swinging object; (2) a wireless transmitter coupled to the swing measurement device and adapted to wirelessly transmit the signal output by the swing measurement device; and (3) a wireless device adapted to receive the wirelessly transmitted signal and to provide information regarding the swinging object based on the received signal. The wireless device is a cellular telephone or personal digital assistant (PDA).

In a second aspect of the invention, a method for monitoring a swing is provided that includes (1) employing a wireless device to receive a wirelessly transmitted signal from a swing measurement device coupled to a swinging object; and (2) employing the wireless device to provide information regarding the swinging object based on the received signal. The wireless device is a cellular telephone or personal digital assistant (PDA).

In a third aspect of the invention, an apparatus is provided that includes a wireless device adapted to receive a wirelessly transmitted signal from a swing measurement device coupled to a swinging object and to provide information regarding the swinging object based on the received signal. The wireless device is a cellular telephone or personal digital assistant (PDA). Numerous other aspects are provided.

Other features and aspects of the present invention will become more fully apparent from the following detailed description, the appended claims and the accompanying drawings.

DETAILED DESCRIPTION

Golf Embodiment

Figure 1:
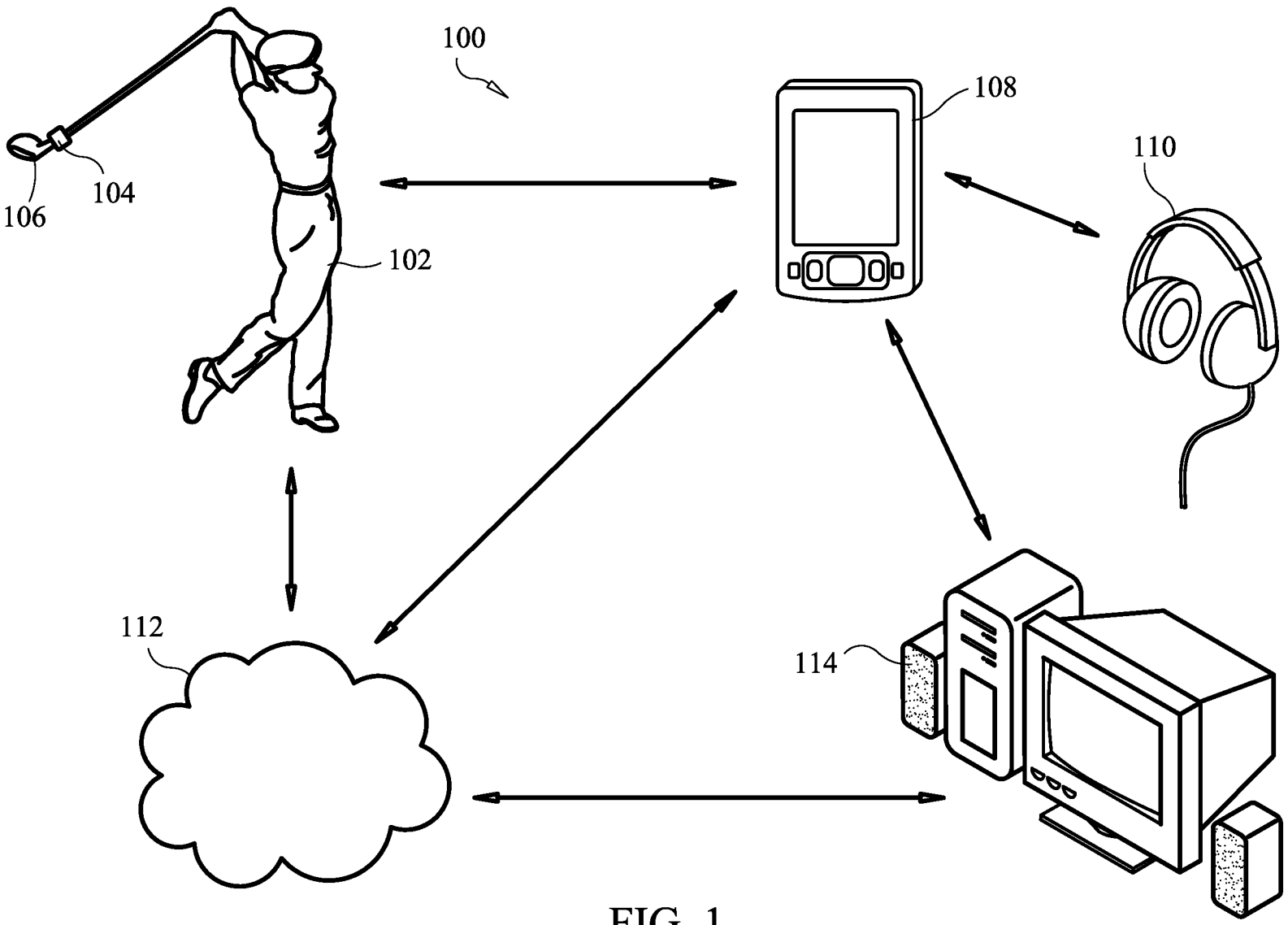
FIG. 1 is a diagram of exemplary components of an illustrative swing training device network provided in accordance with the present invention.

In accordance with one or more embodiments of the invention, a system is provided for monitoring golf performance and/or play. The golf monitoring system may be employed to monitor swing performance during golf play, including swing tempo, swing velocity, ball-club contact force, and/or the like. In some embodiments, each golf club to be employed by a golfer is equipped with an accelerometer and a Bluetooth™ or other wireless transmitter. Each accelerometer may be positioned on or in a golf club and employed to measure acceleration of the golf club during a golf swing. This acceleration may be used to determine swing tempo, swing velocity, ball-club contact and/or contact force, number of strokes of the golfer, and the like, predict ball travel distance and/or position, etc. A Bluetooth™ or other wireless transmitter may receive an acceleration signal, such as a voltage or current level, from the accelerometer and transmit information regarding the acceleration signal to a wireless device such as a cellular telephone, a personal digital assistant (PDA), an MP3 player, a portable game player, or the like.

In one or more embodiments, the wireless device includes software, such as computer program code and/or one or more computer program products, adapted to monitor and/or process the information transmitted by the Bluetooth™ or other wireless transmitter coupled to each golf club. For example, the wireless device may employ the information received from each wireless transmitter to determine (1) the type of golf club being used (e.g., a wood, an iron, a 9 iron, a putter, etc., such as by associating an identifier of a wireless transmitter with a particular club); (2) the acceleration of the club during a swing (e.g., club head acceleration); (3) the velocity and/or speed of the club during a swing (4) swing tempo; (5) ball-club contact; (6) ball-club contact force; (7) ball-club contact timing; (8) follow through speed, timing and/or tempo; (9) number of strokes of the golf club and/or golfer; (10) predicted ball travel distance (e.g., based on ball-club contact force, club type, swing speed, etc.); (11) predicted ball position (e.g., based on ball-club contact force, club type, swing speed, etc.); (12) golf score; (13) golf handicap; and/or any other similar information.

In one particular embodiment, each golf club in a golfer's golf bag may include an accelerometer and a Bluetooth™ transmitter that are "paired" or otherwise configured to communicate with a cellular telephone such as a Palm® Treo™ or other cellular telephone. During golf play, the cellular telephone may monitor and/or analyze each swing of a golfer to determine, record, display and/or otherwise manipulate swing data of the golfer (e.g., to determine any of (1)-(13) above, or any other relevant information). For example, the cellular telephone may track number of swings for each golf hole. In some embodiments, the cellular telephone may prompt a golfer to indicate when a swing is a practice swing, and should not be counted toward a golf score (e.g., by pressing a key on the cellular telephone, speaking a command, etc.). The cellular telephone may graph or chart swing information, compare the same to historical information about the golfer's swings or the swings of an instructor or golf pro (e.g., swing tempo, club velocity and/or speed, ball-club contact force, etc). Numerical acceleration and/or speed, ball-club contact force, etc., may also be provided, so as to allow a golfer to easily compare his/her swing data to that of other golfers. In some embodiments, a wireless device may be paired or otherwise configured to receive swing and/or club information from multiple golfers (e.g., to track the golf score or other swing statistics of a group of golfers). As stated, other wireless transmitters and/or wireless devices may be employed.

Tennis Embodiment

In accordance with one or more other embodiments of the invention, a system is provided for monitoring tennis performance and/or play. The tennis monitoring system may be employed to monitor swing performance during tennis play, including swing tempo, swing velocity, ball-racquet contact force, and/or the like. In some embodiments, a tennis racquet to be employed by a tennis player is equipped with an accelerometer and a Bluetooth™ or other wireless transmitter. Each accelerometer may be positioned on or in a tennis racquet and employed to measure acceleration of the tennis racquet during a swing. This acceleration may be used to determine swing tempo, swing velocity, ball-racquet contact and/or contact force, number of swings of the tennis player, and the like, predict ball travel distance and/or position, etc. A Bluetooth™ or other wireless transmitter may receive an acceleration signal, such as a voltage or current level, from the accelerometer and transmit information regarding the acceleration signal to a wireless device such as a cellular telephone, a personal digital assistant (PDA), an MP3 player, a portable game player, or the like.

In one or more embodiments, the wireless device includes software, such as computer program code and/or one or more computer program products, adapted to monitor and/or process the information transmitted by the Bluetooth™ or other wireless transmitter coupled to a tennis racquet. For example, the wireless device may employ the information received from a wireless transmitter to determine (1) the type of racquet being swung; (2) the acceleration of the racquet during a swing; (3) the velocity and/or speed of the racquet during a swing (4) swing tempo; (5) ball-racquet contact; (6) ball-racquet contact force; (7) ball-racquet contact timing; (8) follow through speed, timing and/or tempo; (9) number of swings of the racquet; (10) predicted ball travel distance (e.g., based on ball-racquet contact force, racquet type, swing speed, etc.); (11) predicted ball position (e.g., based on ball-racquet contact force, racquet type, swing speed, etc.); and/or any other similar information.

In one particular embodiment, a tennis racquet may include an accelerometer and a Bluetooth™ transmitter that are "paired" or otherwise configured to communicate with a cellular telephone such as a Palm® Treo™ or other cellular telephone. During tennis play, the cellular telephone may monitor and/or analyze each swing of a tennis player to determine, record, display and/or otherwise manipulate swing data of the tennis player (e.g., to determine any of (1)-(11) above, or any other relevant information). For example, the cellular telephone may track number of swings for a point, set, game, etc. In some embodiments, the cellular telephone may prompt a tennis player to indicate when a swing is a practice swing, and should not be counted (e.g., by pressing a key on the cellular telephone, speaking a command, etc.). The cellular telephone may graph or chart swing information, compare the same to historical information about the player's swings or the swings of an instructor or tennis pro (e.g., swing tempo, racquet velocity and/or speed, ball-racquet contact force, etc). Numerical acceleration and/or speed, ball-racquet contact force, etc., may also be provided, so as to allow a player to easily compare his/her swing data to that of other tennis players. In some embodiments, a wireless device may be paired or otherwise configured to receive swing and/or racquet information from multiple tennis players (e.g., to track the score or other swing statistics of a group of tennis players, such as two or more tennis players during a tennis game). As stated, other wireless transmitters and/or wireless devices may be employed.

In general, any swinging device may be similarly equipped, such as a hockey stick, a racquet ball racquet, a boxing glove, a kick boxer's leg, etc. For example, the number and/or force of punches during a boxing match may be monitored and/or analyzed.

Exemplary Swing Measurement and/or Analysis Network

Figure 4:
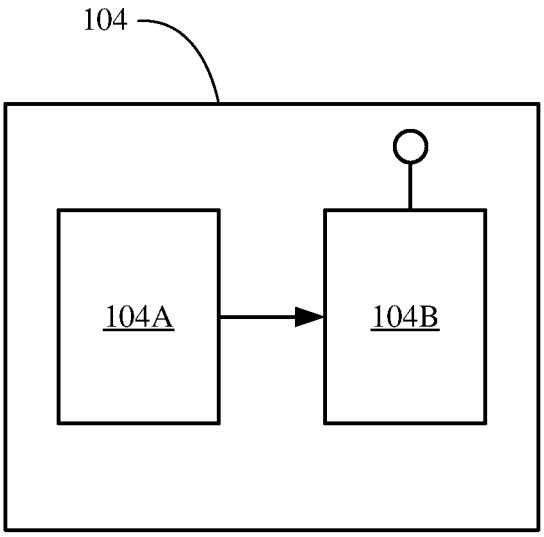
FIG. 4 illustrates a block diagram of a swing measurement device including an accelerometer and a wireless transmitter in accordance with one or more embodiments.

Use of a wireless device in a swing measurement and/or analysis network 100 in accordance with the present invention is illustrated in FIG. 1. With reference to FIG. 1, a user 102, such as a golfer, may employ a swing measurement device 104 to measure swing information of a swinging object, such as a golf club 106. In some embodiments, the swing measurement device 104 may be an accelerometer 104*a* coupled to a wireless transmitter 104*b* (as shown in FIG. 4) or any other suitable device for measuring and transmitting swing information of a swinging object. The swing measurement device 104 may be, for example, located on and/or in the swinging object, and is adapted to send signals (e.g., via a Bluetooth™ or other transmitter) indicative of the swing information (e.g., club acceleration, speed and/or velocity, swing tempo, club-ball impact force, etc.) to a wireless device 108.

In some embodiments, based on the received signals, the wireless device 108 may output auditory cues indicative of swing information to headphones 110. For tracking purposes, the swing measurement device 104 may be adapted to send swing information to the Internet 112, which may in turn transfer that information to the user's or another computer 114. Wireless device 108 may also transfer information to the computer 114, either directly, or through the Internet 112.

In one or more embodiments, the user 102 may use the swing measurement device 104 to measure swing tempo. In an exemplary embodiment, the swing measurement device 104 may comprise an accelerometer which outputs a voltage signal based on measured acceleration of the swinging object, a voltage-to-frequency converter coupled to the accelerometer which produces an audio signal in response to the voltage signal, and a wireless transmitter which transmits the audio signal to the wireless device 108 and/or the headphones 110. In another embodiment, the swing measurement device 104 may comprise an accelerometer that produces an output signal based on the acceleration of the swinging object, and a wireless transmitter that transmits the output signal to the wireless device 108. The wireless device 108 then may convert the output signal into an audio signal (e.g., via software) for output by the wireless device 108 and/or for transmission to and output by the headphones 110. Other appropriate swing measurement devices may be used.

Wireless device 108 may be any wireless device that is capable of receiving the signals transmitted from the swing measurement device 104 (e.g., by supporting Bluetooth™, WiFi, or similar technology). An exemplary wireless device may be, for example, a cellular telephone, web-enabled device (e.g., web-enabled cellular telephone or PDA), portable web browser, cellular or web-enabled wrist watch, web-enabled or otherwise portable gaming device (e.g., Sony PSP®, Nintendo DS™, etc.), or any other suitable device. The wireless device 108 may be capable of receiving, transmitting, storing, compiling, logging, tabulating, and/or analyzing swing information received from the swing measurement device 104 employed by the user 102.

Headphones 110 may be any conventional listening device adapted to receive wireless (e.g., Bluetooth™), wired or similar signals. Similarly, connectivity to the Internet 112 and/or the computer 114 from the swing measurement device 104 and/or wireless device 108 may be made via Bluetooth™, WiFi, or similar signals.

Figure 2:
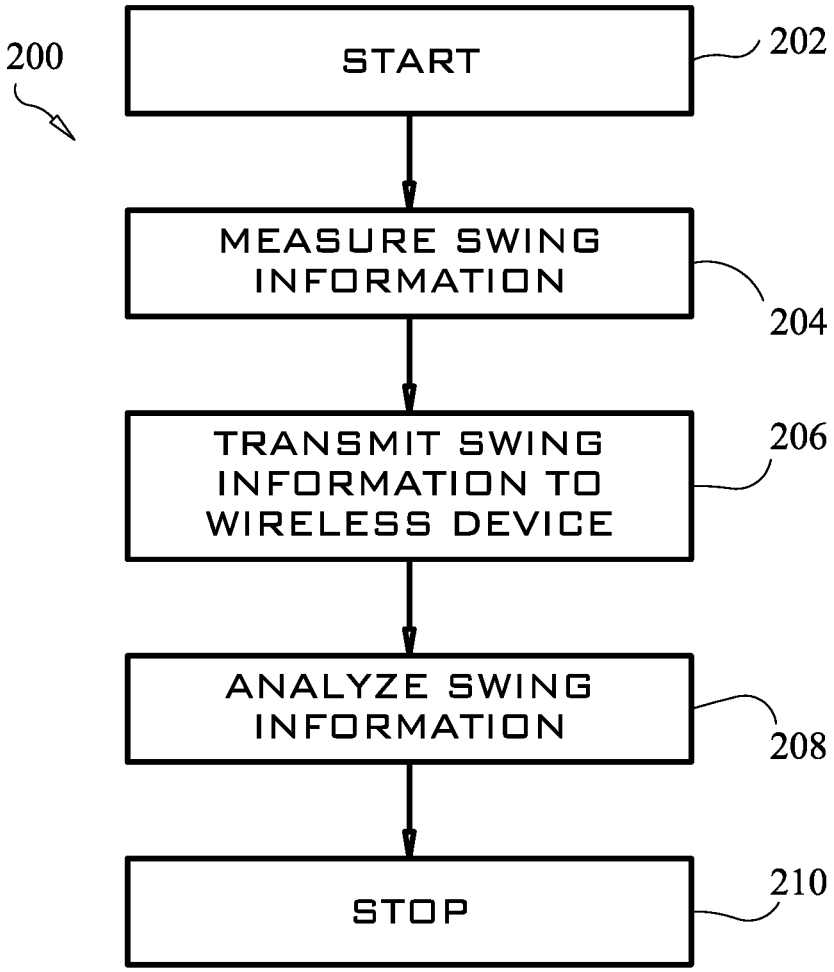
FIG. 2 is a flow chart of an exemplary method of using a wireless swing monitoring device provided in accordance with the present invention.

FIG. 2 depicts an exemplary method 200 of using the wireless device 108 and the swing measurement device 104 according to some aspects of the present invention. The method 200 begins at step 202.

In operation, the user 102 swings a club with a swing measurement device 104 attached or included therein, such as a wirelessly-enabled (e.g., Bluetooth™ enabled) accelerometer. Swing information (e.g., swing tempo or any other information) is measured at step 204, preferably in real time, by the swing measurement device 104.

At step 206, the swing information is communicated to the wireless device 108 (e.g., a cellular telephone, a PDA, etc.). In certain embodiments, the wireless device 108 may transmit swing information to another device (e.g., headphones, the Internet, a computer, etc.); in the same or alternative embodiments, the swing information may be transmitted directly to the other device from the swing measurement device 104.

In an exemplary embodiment, the wireless device 108 may send a real time audio signal indicative of swing tempo to headphones 110. In this way, the user 102 may privately listen to an auditory representation of the swing tempo and adjust the swing tempo of his/her swing without disturbing other golfers. Similarly, the wireless device 108 may transmit the audio signal to an iPod, personal mp3 player, or similar audio device. The signal may be recorded for future playback and/or played live via attached headphones or speakers so the user 102 may hear the tempo of the swing. In some embodiments, the audio signal may be transmitted directly from a Bluetooth™ enabled club to the audio device.

Figure 3A:
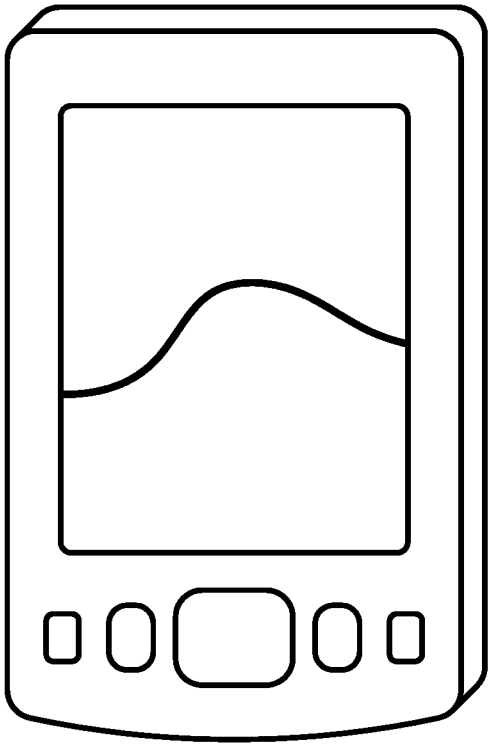
FIGS. 3A and 3B are illustrative exemplary wireless swing training devices in accordance with some embodiments of this invention.

In step 208, the wireless device 108 may analyze the swing information. For example, the wireless device 108 may display a graphical representation of the swing information (e.g., swing tempo, club head speed, velocity and/or acceleration, club-ball contact force and/or time, etc.) on a screen or other display of the wireless device 108. An example of such a representation is shown in FIG. 3A. The user 102 may then visually analyze the swing after it is completed and/or allow another user (e.g., a coach or caddy) to evaluate the swing in progress. In some embodiments, the graphical representations may be stored in a database of swings. The swings may then be reviewed and/or overlayed to closely compare any variations in swings. For example, a reference or ideal drive swing tempo may be loaded into a database on wireless device 108.

Database storage and/or tracking may also occur at computer 114 or on the Internet 112 (e.g., at a Web server of a golf related Web site). Each time the user 102 swings, swing information may be recorded and/or displayed graphically over reference swing information and/or previous swings. Preferably, the wireless device 108 is a small, hand-held device the user 102 may carry on his/her person (e.g., a cellular telephone, a PDA, etc.). In this way, the user 102 may see where a swing may be adjusted to realize an optimal swing while on the golf course (or other playing field for alternative swing applications such as tennis).

In some embodiments, the wireless device 108 may track the current swing and output a cue if the swing varies greatly from an ideal swing. For example, if the user 102 is exceeding the necessary swing tempo at the top of the swing, the wireless device 108 may vibrate and/or emit a tone. In this way, the user 102 will be alerted to the error and may stop the swing before ball contact.

In a similar fashion, the wireless device 108 may output a cue if the swing is ideal or very good. For example, if the measured tempo from a swing start through contact with the ball to the follow through indicates a good drive, the wireless device 108 may send a text message to a predetermined list of persons or otherwise alert others that the user 102 hit a good drive. The wireless device 108 may also calculate an approximate or anticipated drive distance based on the measured swing information and report this to the user 102 and/or include this information in the sent message.

In some embodiments, swing information received at the wireless device 108, Internet 112, and/or computer 114 may be tracked in a tracking program. The information may be transmitted via wired and/or wireless signals over the Internet 112 and/or transmitted directly to a personal computer 114, golf computer, or other device with golf tracking software loaded thereon.

In some embodiments, the wireless device 108 may track swing information and may additionally track the score for a user's game. For example, swing measurement devices (e.g., accelerometers) may be attached to (or in) each of the user's 102 clubs and/or may be easily transferred therebetween. In such embodiments, the swing measurement devices may be sufficiently small and light so as to not impede or otherwise hamper the swing of the user 102. The wireless device 108 may track the number of swings (strokes) taken by the user 102 using some or all clubs. In some embodiments, the wireless device 108 may differentiate between practice swings and strokes by determining the amount and/or speed of deceleration at ball-contact and/or the end of the stroke. For example, in a completed stroke, there may be a noticeable change in the swing tempo at the point of contact with the ball, indicating a stroke whereas in a practice swing, a swing tempo change may be reduced and/or may not be present. The user 102 may also input penalties into the wireless device 108 which would not normally be recorded otherwise. Using the total score for a round or rounds, the wireless device 108 may also calculate a user's 102 handicap.

In some embodiments, especially when more than one user 102 employs the wirelessly-enabled clubs and wireless device 108, the wireless device 108 may track various types of games and/or propositions. For example, the wireless device 108 may track the scores of an entire foursome or even a tournament. Different types of play may be accommodated, such as match play, skins games, and/or best ball tournaments. In some embodiments, the wireless device 108 may be capable of calculating an approximate landing position of the ball based on swing information and compare this estimation to other users. In this way, ball position may be tracked on a golf course and an estimation of the most appropriate ball to hit in a best ball or scramble-type game may be determined.

Figure 3B:
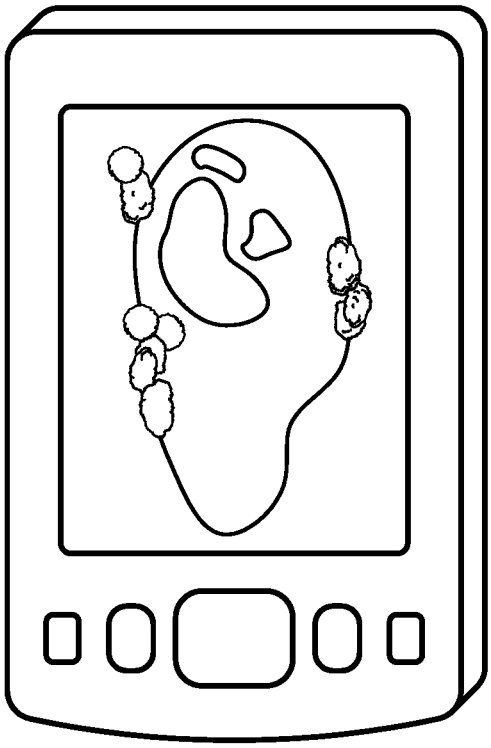

To further aid a user 102 to track a golf game, the wireless device 108, clubs, and/or ball may be GPS equipped. In this way, the user 102 may have real time accurate information of where the user 102 is in relation to a ball, a pin, the 19th hole, etc. FIG. 3B represents an example of a golf mapping program which may be used in conjunction with the present invention. Golf mapping programs are commercially available from, for example, Golfwits, LLC of Lynden, Wash. and StarCaddy, manufactured by LinksPoint of Norwalk, Conn.

Used in coordination, the present invention and golf course mapping software may provide useful tools to a user. For example, a GPS enabled wireless device may track the movements of the user and provide information such as location on the course, distance to hole, etc. Based on swing tempo, other swing information and/or course terrain downloaded from the course map, the wireless device 108 may calculate an approximate landing location of a ball after a swing. This tentative landing location may be plotted on the golf course mapping software and the user may utilize the GPS capabilities to find the golf ball. This may be especially useful with errant shots or blind turns. The wireless device 108 may also suggest shots and clubs based on a record of previous swings (e.g., prior swing measurements such as prior swing tempo achievement). For example, if the user is not achieving a certain swing tempo, indicating an inability to hit high or long shots, the wireless device 108 may suggest a two shot approach to a dogleg instead of attempting to fly over. Additionally, based on terrain and location on the map, the wireless device 108 may calculate an alternate swing tempo or other swing adjustment for the user. This alternate swing may help the golfer hit a further and/or more accurate shot or may encourage a shorter shot or lay-up.

The method ends at step 210.

The foregoing description discloses only exemplary embodiments of the present invention. Modifications of the above disclosed apparatus and methods which fall within the scope of the invention will be readily apparent to those skilled in the art. Specific components may be substituted with equivalent components and the number of components may be increased or reduced and still remain within the scope of the present invention. A swing measurement apparatus may be employed for teaching proper swing (e.g., swing tempo) for a tennis racket, baseball bat or hockey stick, to teach proper casting during fly fishing, proper tempo during bowling, and to monitor the velocity of a baseball player's throwing arm. Further, a boxer or martial artist may use the apparatus to monitor the velocity and/or acceleration (and thus the force) of punches or kicks. Additionally, any modulation and transmission scheme may be used for transmitting information to remote locations.

Also, although discussed primarily with regard to Bluetooth™ technology, it is understood that signals may be sent to and/or from the swing measurement device, wireless device, and other devices via other means, such as Short Message Service, IEEE 802.11b (WiFi), Ultra Wide Band (UWB), WiMax, etc. Additionally, while the present invention has primarily been described with reference to a single user, it will be understood that the invention is equally applicable to multiple user situations.

Accordingly, while the present invention has been disclosed in connection with exemplary embodiments thereof, it should be understood that other embodiments may fall within the spirit and scope of the invention, as defined by the following claims.

What is claimed is:

1. A system for monitoring a golf swing comprising:

a swing measurement device having one or more accelerometers that monitor acceleration of the swing measurement device as the swing measurement device swings so as to generate acceleration information, the swing measurement device adapted to couple to a golf club and to output a signal indicative of acceleration of the golf club measured as the golf club swings;

a wireless transmitter coupled to the swing measurement device and adapted to wirelessly transmit the signal output by the swing measurement device; and, a program executable on a cellular telephone, wherein the program allows the cellular telephone to:

wirelessly communicate with the swing measurement device when the swing measurement device is coupled to the golf club;

receive acceleration information wirelessly from the swing measurement device measured as the swing measurement device swings with the golf club;

collect acceleration information based on the monitored acceleration of the swing measurement device measured as the swing measurement device swings with the golf club;

analyze the collected acceleration information to determine one or more characteristics of a golf swing based on the collected acceleration information;

output information regarding the one or more characteristics of the golf swing on a display of the cellular telephone;

effectuate storing of swing information for multiple golf swings;

effectuate analysis of swing information regarding previous golf swings to determine a recommended golf shot for a user; and provide the recommended golf shot to the user.

2. The system of claim 1 wherein the program executable on the cellular telephone determines one or more of acceleration of the golf club, velocity of the golf club, and speed of the golf club.

3. The system of claim 1 wherein the program executable on the cellular telephone determines one or more of ball-club contact, ball-club contact timing and ball-club contact force.

4. The system of claim 1 wherein the program executable on the cellular telephone determines one or more of number of strokes of the golf club, number of strokes of a golfer swinging the golf club, and golf handicap.

5. The system of claim 1 wherein the program executable on the cellular telephone causes the cellular telephone to transmit swing information to a server.

6. The system of claim 1 wherein the program executable on the cellular telephone causes the cellular telephone to detect wirelessly transmitted signals from multiple golfers.

7. The system of claim 6 wherein the program executable on the cellular telephone causes the cellular telephone to track a golf score of multiple golfers based on wirelessly transmitted signals.

8. The system of claim 1 wherein the program executable on the cellular telephone causes the cellular telephone to send a message to one or more persons regarding a quality of the golf swing.

9. A system for monitoring a swing comprising:

a swing measurement device having one or more accelerometers that monitor acceleration of the swing measurement device as the swing measurement device swings so as to generate acceleration information, the swing measurement device adapted to couple to a golf club and to output a signal indicative of acceleration of the golf club;

a wireless transmitter coupled to the swing measurement device and adapted to wirelessly transmit the signal output by the swing measurement device; and, a program executable on a cellular telephone adapted to receive the wirelessly transmitted signal;

wherein the program executable on the cellular telephone allows the cellular telephone to:

wirelessly communicate with the swing measurement device when the swing measurement device is coupled to the golf club;

receive acceleration information wirelessly from the swing measurement device;

analyze the acceleration information to determine one or more characteristics of a golf swing including number of strokes; and output information regarding the one or more characteristics of the golf swing on a display of the cellular telephone.

10. The system of claim 9 wherein the program executable on the cellular telephone causes the cellular telephone to detect wirelessly transmitted signals from multiple golfers.

11. The system of claim 10 wherein the program executable on the cellular telephone causes the cellular telephone to track the golf score of multiple golfers.

12. The system of claim 9 wherein the program executable on the cellular telephone causes the cellular telephone to transmit swing information over the Internet.

13. The system of claim 9 wherein the program executable on the cellular telephone causes the cellular telephone to send a message to one or more persons regarding a quality of the golf swing.

14. The system of claim 9 wherein the program executable on the cellular telephone causes the cellular telephone to transmit swing information to a server.

15. A system for monitoring a swing comprising:

a swing measurement device having one or more accelerometers that monitor acceleration of the swing measurement device as the swing measurement device swings so as to generate acceleration information, the swing measurement device adapted to couple to a golf club and to output a signal indicative of acceleration of the golf club;

a wireless transmitter coupled to the swing measurement device and adapted to wirelessly transmit the signal output by the swing measurement device; and, a program executable on a cellular telephone adapted to receive the wirelessly transmitted signal;

wherein the program executable on the cellular telephone allows the cellular telephone to:

wirelessly communicate with the swing measurement device when the swing measurement device is coupled to the golf club;

receive acceleration information wirelessly from the swing measurement device;

analyze the acceleration information to determine one or more characteristics of a golf swing including golf score; and output information regarding the one or more characteristics of the golf swing on a display of the cellular telephone.

16. The system of claim 15 wherein the program executable on the cellular telephone causes the cellular telephone to detect wirelessly transmitted signals from multiple golfers.

17. The system of claim 16 wherein the program executable on the cellular telephone causes the cellular telephone to track the golf score of multiple golfers.

18. The system of claim 15 wherein the program executable on the cellular telephone causes the cellular telephone to transmit swing information over the Internet.

19. The system of claim 15 wherein the program executable on the cellular telephone causes the cellular telephone to send a message to one or more persons regarding a quality of the golf swing.

20. The system of claim 15 wherein the program executable on the cellular telephone causes the cellular telephone to transmit swing information to a server.

* * * * *